US008833597B1

(12) United States Patent
Goldsmith

(10) Patent No.: US 8,833,597 B1
(45) Date of Patent: Sep. 16, 2014

(54) STRAW GUIDE CONTAINER THAT HOLDS DRY ICE

(71) Applicant: Ira Goldsmith, Hialeah, FL (US)

(72) Inventor: Ira Goldsmith, Hialeah, FL (US)

( * ) Notice: Subject to any disclaimer, the term of this patent is extended or adjusted under 35 U.S.C. 154(b) by 12 days.

(21) Appl. No.: 13/891,315

(22) Filed: May 10, 2013

(51) Int. Cl.
*A47G 23/04* (2006.01)
*A47G 19/22* (2006.01)

(52) U.S. Cl.
CPC ..... *A47G 23/04* (2013.01); *A47G 19/2222* (2013.01)
USPC ..... 220/710; 220/705

(58) Field of Classification Search
CPC .... B65D 77/286; B65D 77/283; B65D 77/28; A47G 19/2222; A47G 19/2266
USPC ..... 220/710, 705, 4.13, 4.23, 4.24, 4.22, 220/4.21; 215/389, 388, 387, 229
See application file for complete search history.

(56) References Cited

U.S. PATENT DOCUMENTS

| | | | | |
|---|---|---|---|---|
| 4,234,080 | A * | 11/1980 | Gellert | 206/0.82 |
| 7,909,176 | B2 * | 3/2011 | Merino | 210/459 |
| 8,333,145 | B2 * | 12/2012 | Kowlessar | 99/426 |
| 2004/0118769 | A1 * | 6/2004 | Merino | 210/459 |
| 2012/0325835 | A1 * | 12/2012 | Merino | 220/705 |

* cited by examiner

*Primary Examiner* — Robert J Hicks
(74) *Attorney, Agent, or Firm* — Ruben Alcoba, Esq.

(57) ABSTRACT

A straw guide container that comprises of a housing that defines a straw guide. The straw guide is on one of the exterior sides of the housing. The housing has a first and a second side. The sides are attached to each other using a vertical latching system. The housing is designed to hold at least one solid carbon dioxide pellet. The housing has a stem that is attached to the exterior of the housing. The stem defines a handle. The handle is used to easily position the container within a beverage.

7 Claims, 4 Drawing Sheets

STRAW GUIDE CONTAINER THAT HOLDS DRY ICE

BACKGROUND

The present invention relates generally to a straw guide container that holds dry ice.

Dry ice is the solid form of carbon dioxide. Its low temperature and direct sublimation to a gas makes dry ice an effective coolant. When dry ice changes to a gas it leaves no residue. Dry ice transforms into a gas by the process of direct sublimation.

The present invention uses dry ice pellets to cool drinks in which the container is immersed while simultaneously producing a mist from the drink.

The container of the present invention is a device that may eliminate the use of ice cubes in some drinks. It is known in the food industry that some ice cube holding devices are not hygienic and that the ice that is used from the ice cube holding devices might be contaminated.

The container of the present invention can be used on hot or cold beverages. When used on hot beverages, the mist effect is maximized.

A benefit of the present invention is that beverages in which the container is immersed in shall be carbonated. The beverages flavor and aroma are enhanced when the beverages are carbonated.

For the foregoing reasons, there is a need for a straw guide container that holds dry ice.

SUMMARY

The present invention is directed to a straw guide container that holds dry ice. The straw guide container is ergonomically designed, it may be disposable, it is inexpensive to manufacture, and it is lightweight.

The straw guide container of the present invention comprises of a housing that defines a straw guide. The straw guide is on one of the exterior sides of the housing. The housing has a first and a second side. The sides are attached to each other using a vertical latching system. The housing is designed to hold at least one solid carbon dioxide pellet.

In a preferred embodiment, the housing further comprises of a stem that is attached to the exterior of the housing. The stem defines a handle. The handle is used to easily position the container within a beverage.

An object of the present invention is to provide a straw guide container that cools a drink in which it is immersed when it is loaded carbon dioxide pellets.

Another object of the present invention is to provide a straw guide container that creates a mist when it is immersed in a liquid when it is loaded with carbon dioxide pellets.

Yet another object of the present invention is to provide a straw guide container that can safely house carbon dioxide pellets.

Yet still another object of the present invention is to provide a straw guide container that can enhance the flavors and aroma of a beverage when it is loaded with carbon dioxide pellets.

A further object of the present invention is to provide an ergonomically designed straw guide container that can be loaded with dry ice pellets in a safe manner.

Still a further object of the present invention is to provide a straw guide container that cart eliminate the use of ice cubes to cool a beverage.

Yet still a further object of the present invention is to provide a straw guide container that can help carbonate a beverage in which it is immersed in when it is loaded with carbon dioxide pellets.

DRAWINGS

These and other features, aspects, and advantages of the present invention will become better understood with regard to the following description, appended claims, and drawings where:

DESCRIPTION

Figure 1:
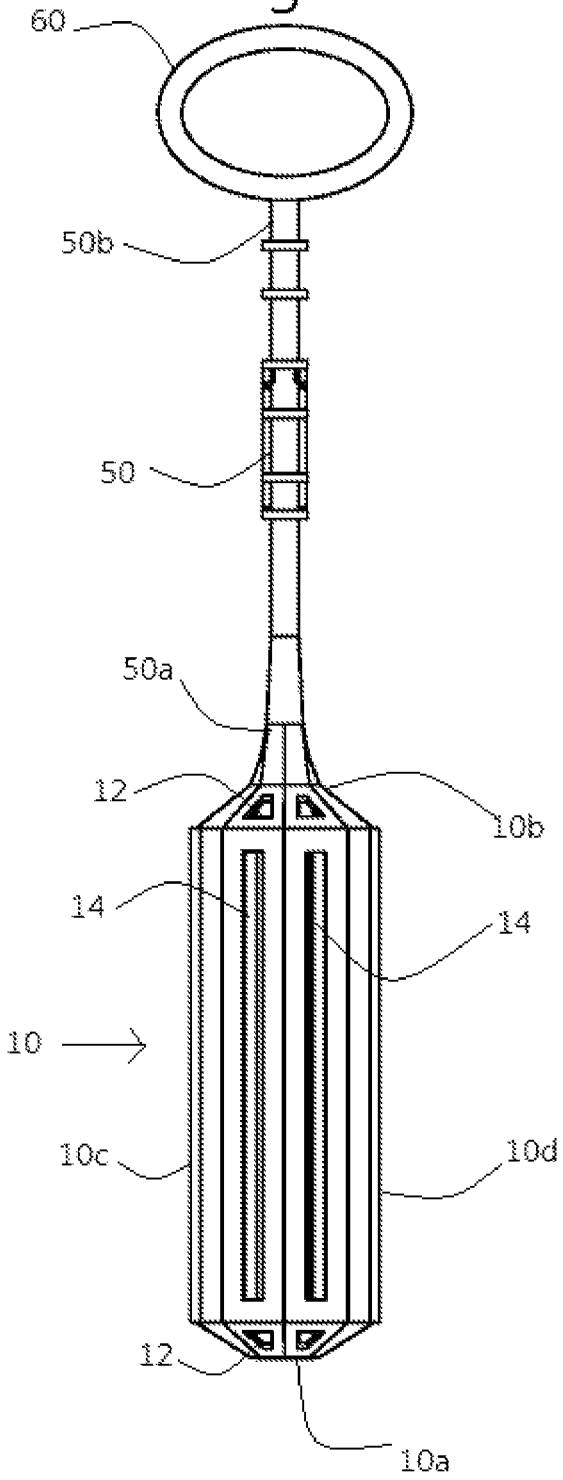
FIG. 1 shows a side vie of the present invention, the view does not show the straw guide.
Figure 2:
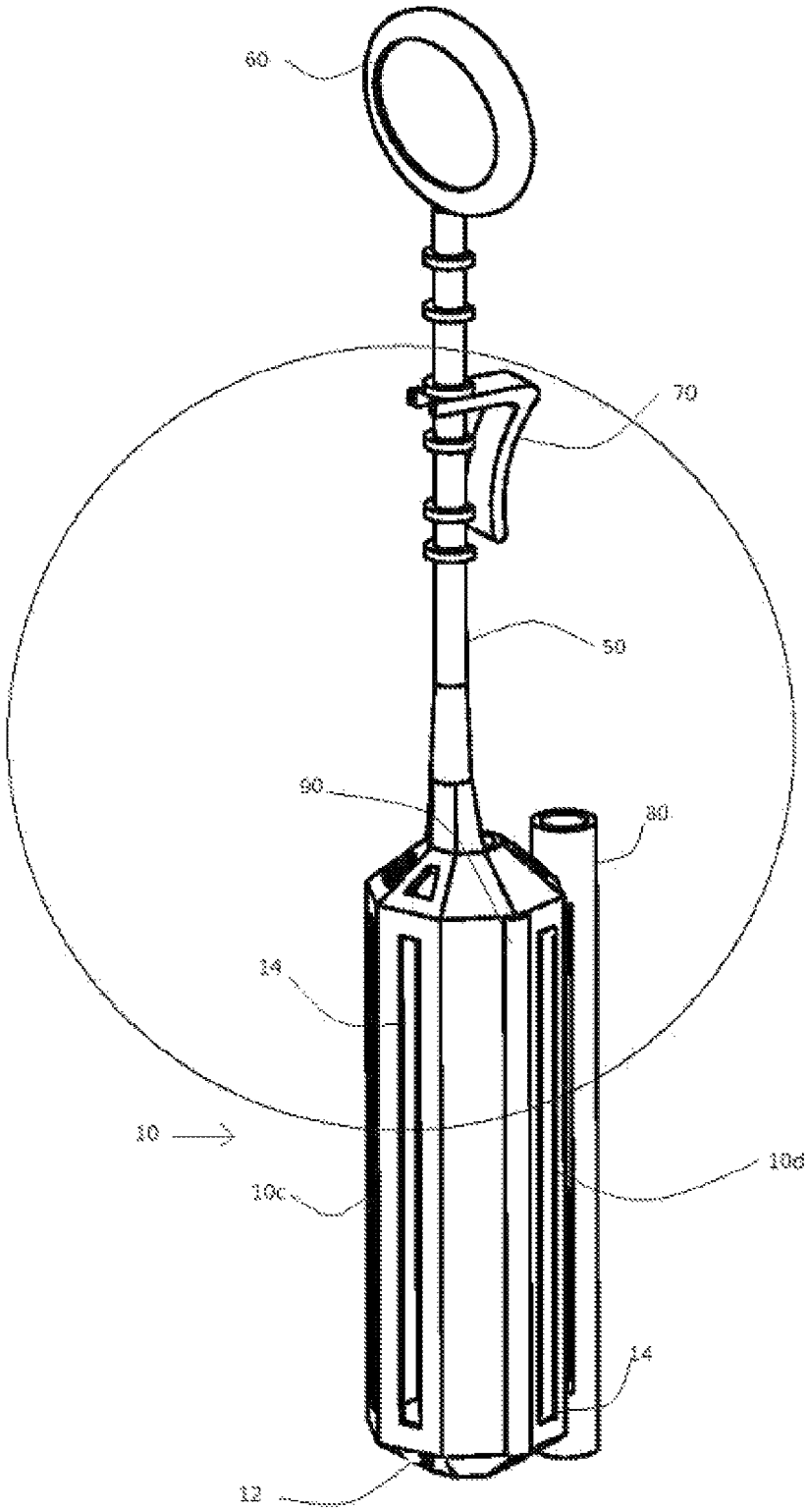
FIG. 2 shows a side view of the present invention with the straw guide.
Figure 3:
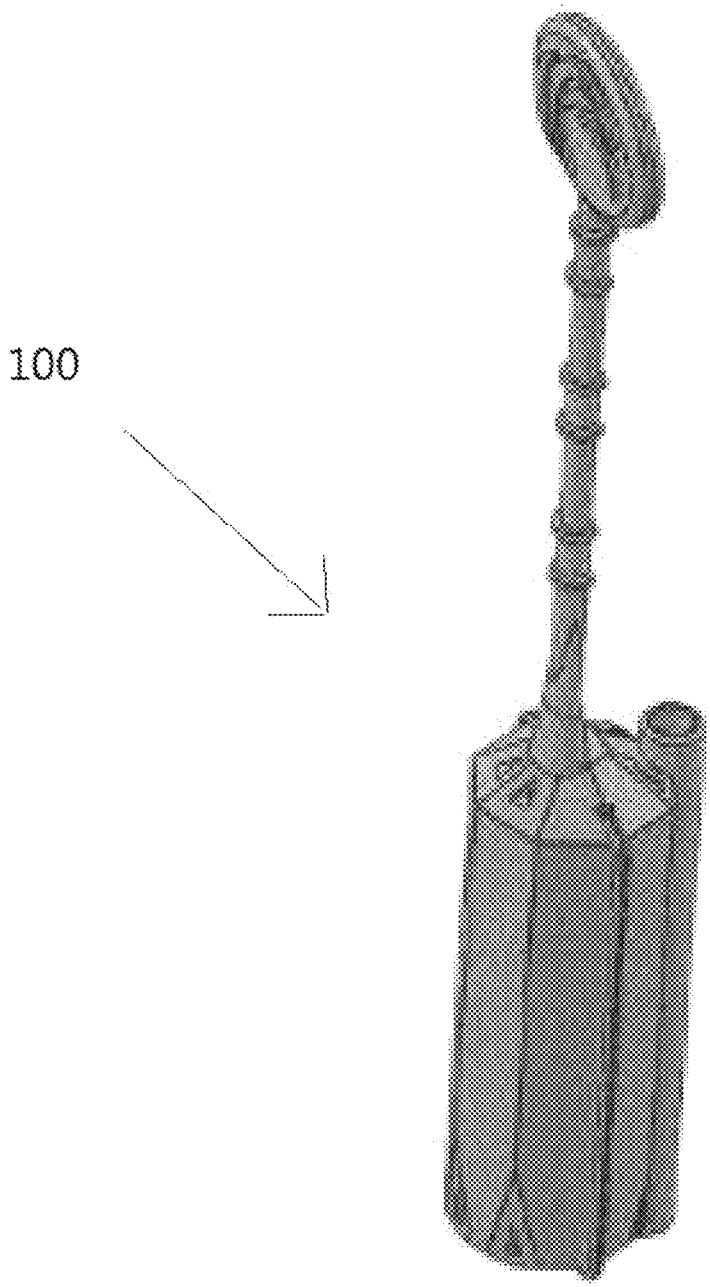
FIG. 3 shows a perspective view of the present invention.
Figure 4:
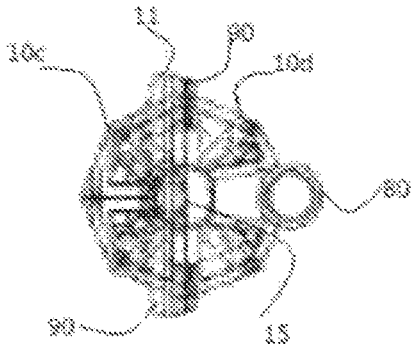
FIG. 4 shows a top plan view of the present invention.

As seen in FIGS. 1-4, the present invention is a straw guide container 100 that holds dry ice. The container 100 comprises of a housing 10, the housing has a top 10*a*, a bottom 10*b*, a first 10*c* and a second side 10*d*, the first 10*c* and the second side 10*d* have four walls that form an approximately octagonal shape when closed, the first 10*c* and second side 10*d* are fixedly attached to each other along the length of one of the walls 11, the walls of the first 10*c* and second side 10*d* that are not fixedly attached have vertical latches 90 that run along the length of the walls that latch onto each other when closed, the top 10*b* and the bottom sides 10*a* define walls that merge toward a center point 15 of the housing 10, the first 10*c* and the second side 10*d* walls define a plurality of vertical slits 14 that run along the length of the first 10*c* and second sides 10*d*, the top 10*b* and bottom sides 10*a* define a plurality of apertures 12. The straw guide container 100 further comprises of a straw guide 80, the straw guide 80 is fixedly attached to one of the walls of the second side 10*d* of the housing 10 and runs vertically to the second side 10*d*.

In a preferred embodiment of the present invention, the straw guide container's 100 measurements are as follows: the length of the side walls are approximately 2.625 inches from the top to the bottom side; the diameter between the opposing side walls of the housing 10 are approximately 0.850 of an inch; and the length of the straw guide 80 is approximately 2.625 inches.

In another embodiment of the present invention, the straw guide container 100 further comprises of a stem 50. The stem 50 has an upper 50*b* and a bottom side 50*a*, the bottom side of the stem 50*a* attaches top side 10*b* of the first side 10*c* of the housing 10 and the top side 50*b* of the stem 50 defines a substantially circular handle 60. In some embodiments, the length of the stem 50 is approximately 3.625 inches.

In a further embodiment of the present invention, the straw guide container 100 may further comprise of a clip 70 that attaches to the stem 50.

In preferred embodiments of the present invention, the straw guide container 100 may be made of plastic, polymers, or stainless steel.

An advantage of the present invention is that it provides a straw guide container that cools a drink in which it is immersed in when it is loaded with carbon dioxide pellets.

Another advantage of the present invention is that it provides a straw guide container that creates a mist when it is immersed in a liquid when it is loaded with carbon dioxide pellets.

Yet another advantage of the present invention is that it provides a straw guide container that safely houses carbon dioxide pellets.

Yet still another advantage of the present invention is that it provides a straw guide container that enhances the flavors and aroma of a beverage when it is loaded with carbon dioxide pellets.

A further advantage of the present invention is that it provides an ergonomically designed straw guide container that can be loaded with dry ice pellets in a safe manner.

Still a further advantage of the present invention is that it provides a straw guide container that eliminates the use of ice cubes to cool a beverage.

Yet still a further advantage of the present invention is that it provides a straw guide container that carbonates a beverage in which it is immersed in when it is loaded with carbon dioxide pellets.

Although the present invention has been described in considerable detail in reference to certain preferred versions thereof, other versions are possible. Therefore, the spirit and scope of the claims should not be limited to the description of the preferred versions contained herein.

What is claimed is:

1. A straw guide container that holds dry ice, the container comprises of:

a housing, the housing has a top, a bottom, a first and a second side, the first and the second side have four walls that form an approximately octagonal shape when closed, the first and second side are fixedly attached to each other along the length of one of the walls, the walls of the first and second side that are not fixedly attached have vertical latches that run along the length of the walls that latch onto each other when closed, the top and the bottom sides define walls that merge toward a center point of the housing, the first and the second side wall define a plurality of vertical slits that run along the length of the first and second side wall, the top and bottom sides define a plurality of apertures; and a straw guide, the straw guide is fixedly attached to one of the walls of the second side of the housing and runs vertically to the second side wall.

2. The straw guide container of claim 1, wherein the length of the side walls are approximately 2,625 inches from the top to the bottom side, the diameter between the opposing side walls of the housing are approximately 0.850 of an inch, and the length of the straw guide is approximately 2.625 inches.

3. The straw guide container of claim 2, further comprising of a stem, the stem has an upper and a bottom side, the bottom side of the stem attaches top side of the first side of the housing and the top side of the stem defines a substantially circular handle.

4. The straw guide container of claim 3, wherein the length of the stem is approximately 3.625 inches.

5. The straw guide container of claim 4, further comprising of a clip that attaches to the stem.

6. The straw vide container of claim 5, wherein the container is made of plastic.

7. The straw guide container of claim 5, wherein the container is made of stainless steel.

* * * * *